United States Patent [19]

Gillum

[11] 4,321,765

[45] Mar. 30, 1982

[54] TWO HANDED HOLDING APPARATUS FOR FIREARMS

[76] Inventor: Richard R. Gillum, 1002 Lake St., Marblehead, Ohio 43440

[21] Appl. No.: 44,567

[22] Filed: Jun. 1, 1979

[51] Int. Cl.[3] ..... F41C 23/00

[52] U.S. Cl. ..... 42/72

[58] Field of Search ..... 42/72, 73, 71 R, 71 P; 89/37 R, 37 B, 37 BA, 37 A

[56] References Cited

U.S. PATENT DOCUMENTS

| | | | |
|---|---|---|---|
| 1,357,208 | 10/1920 | Payne | 42/72 |
| 1,386,247 | 8/1921 | Fordyce | 42/71 R |
| 1,695,071 | 12/1928 | Villalpando | 42/71 R |
| 1,883,465 | 10/1932 | Balmer | 42/71 R |
| 2,279,601 | 4/1942 | Trotter | 89/37 B |
| 2,436,175 | 2/1948 | Neal | 42/71 R |
| 2,826,848 | 3/1958 | Davies | 42/71 R |
| 2,985,980 | 5/1961 | Broshous | 42/94 |
| 3,553,878 | 1/1971 | Cannon | 42/72 |
| 3,609,902 | 10/1971 | Casull | 42/72 |
| 3,648,396 | 3/1972 | Smith | 42/72 |

FOREIGN PATENT DOCUMENTS

| | | | |
|---|---|---|---|
| 392324 | 9/1965 | Switzerland | 42/72 |
| 503324 | 4/1939 | United Kingdom | 42/71 R |

*Primary Examiner*—Charles T. Jordan

*Attorney, Agent, or Firm*—Allan R. Fowler

[57] ABSTRACT

Two handed holding apparatus for all types of hand held firearms, including handguns, rifles, submachine guns and the like, includes a first handle fixed to the firearm to one side of a barrel bore axis and a second handle fixed to the firearm to an opposite side of the barrel bore axis in alignment with the first handle. The two handles, adapted to be individually held by one of a user's hands, divide firing recoil between the user's hands in a generally symmetrical manner to eliminate muzzle jump. For handguns, having a preexisting handle, a frame extension is provided, to a projecting end of which the second handle is fixed in orthogonal relationship to the first handle. To convert existing handguns, the frame extension is attached to the first handle and replaces one of the existing handgrips. The frame extension is configured to receive a pistol scope or fixed sights. In a variation, the frame extension is permanently fixed to the pistol frame, as an addition or as part of the original frame. For non-handgun firearms, such as rifles, first and second handles are fixed in coplaner relationship to a frame attached to the barrel at a balance point. To modify existing types of such firearms, the shoulder stock is removed and replaced with a short receiver enclosing stock, to a rearward end of which is attached a carrying and firearm supporting sling. A trigger link connected to an existing trigger enables firing of the firearm by a hand holding one of the two added handles.

18 Claims, 17 Drawing Figures

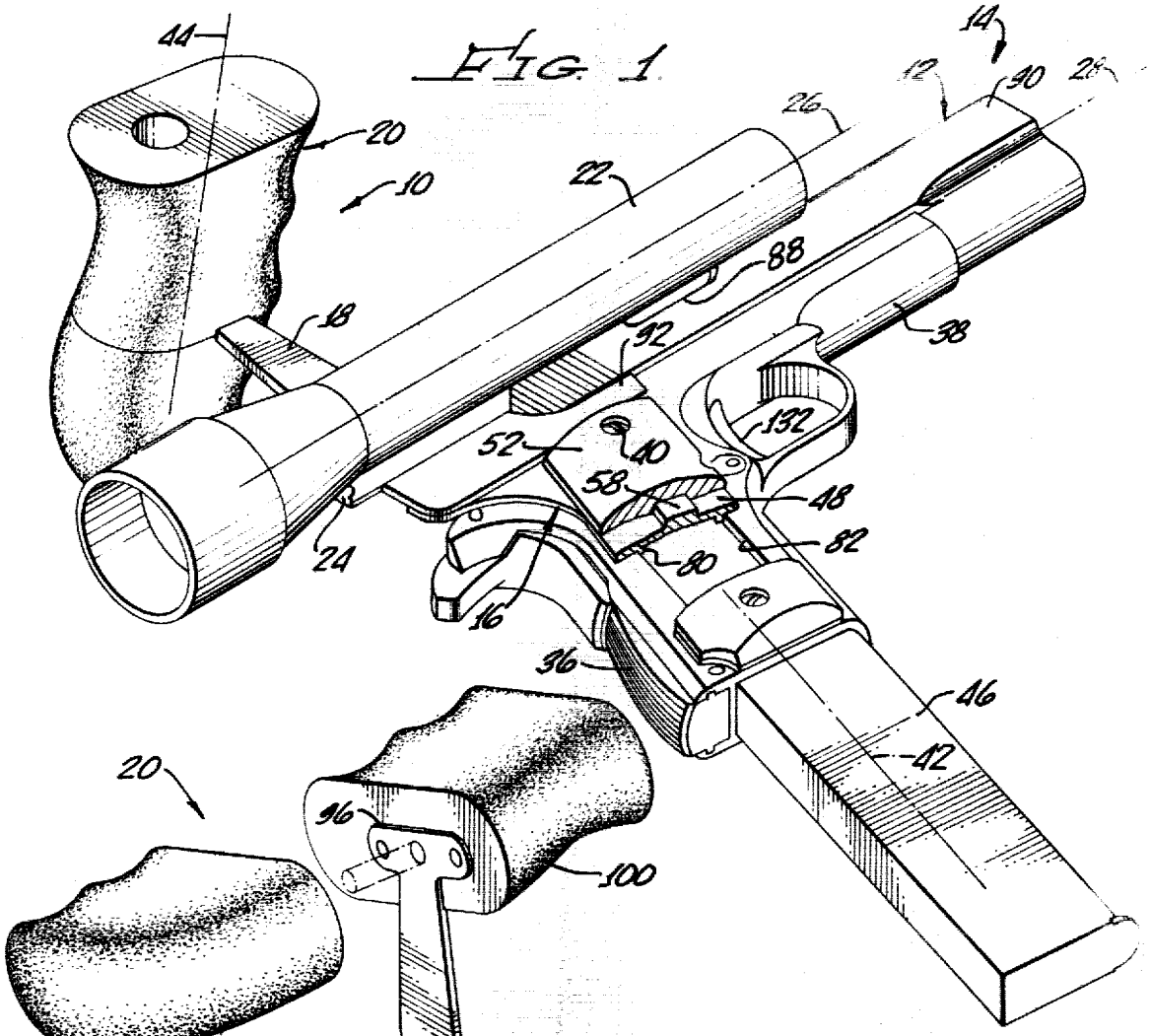
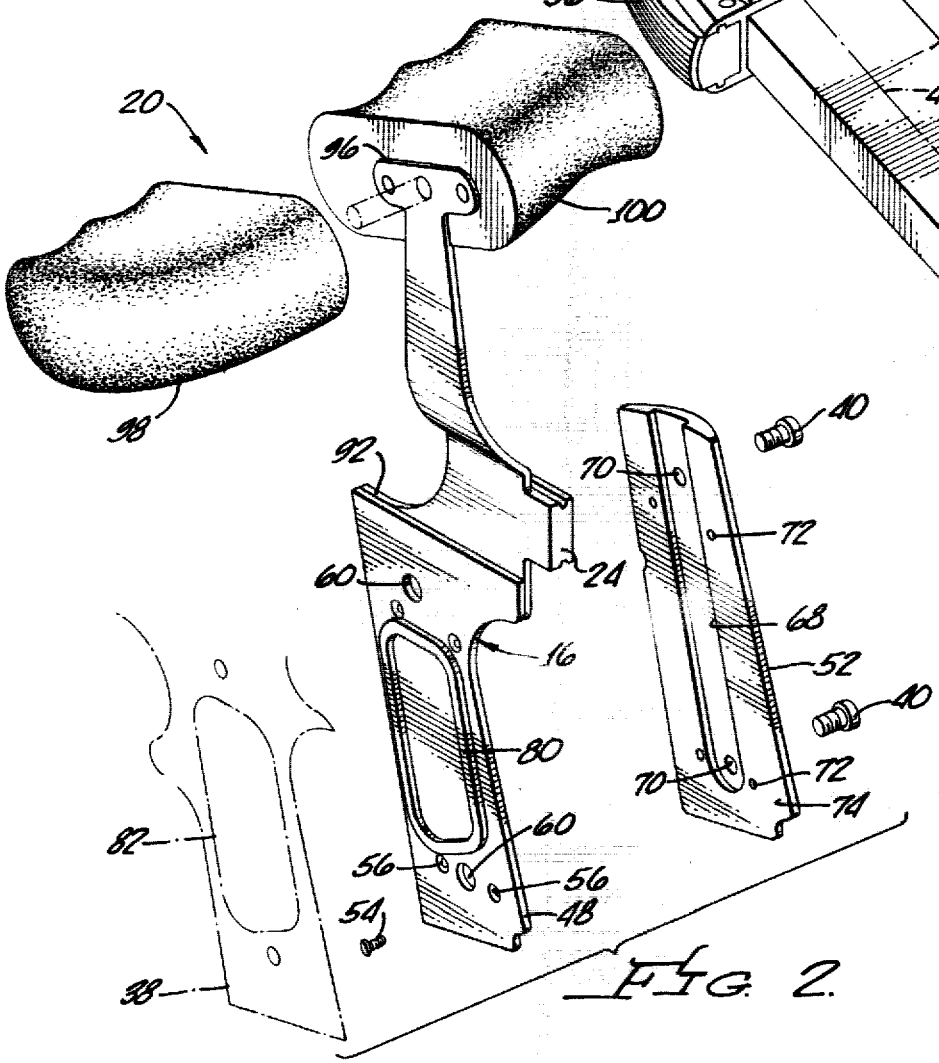
FIG. 2

FIG. 8.
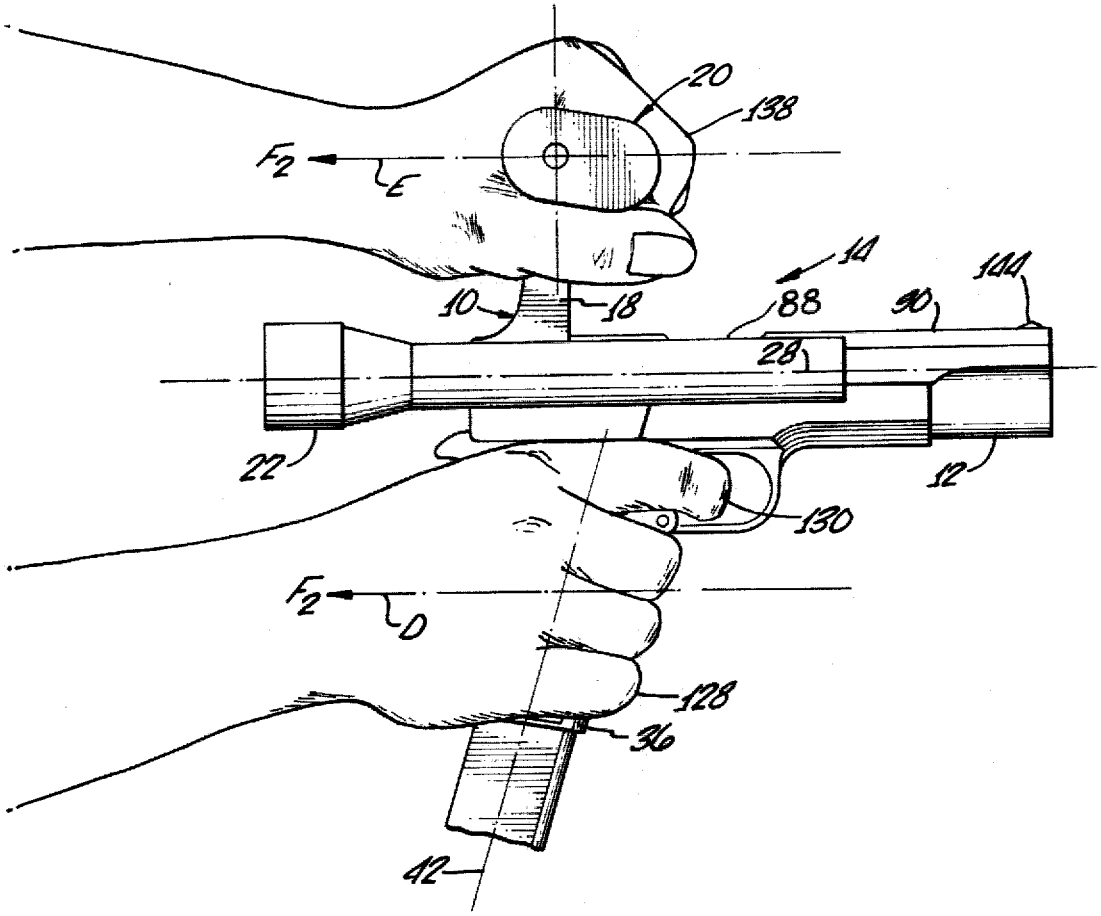
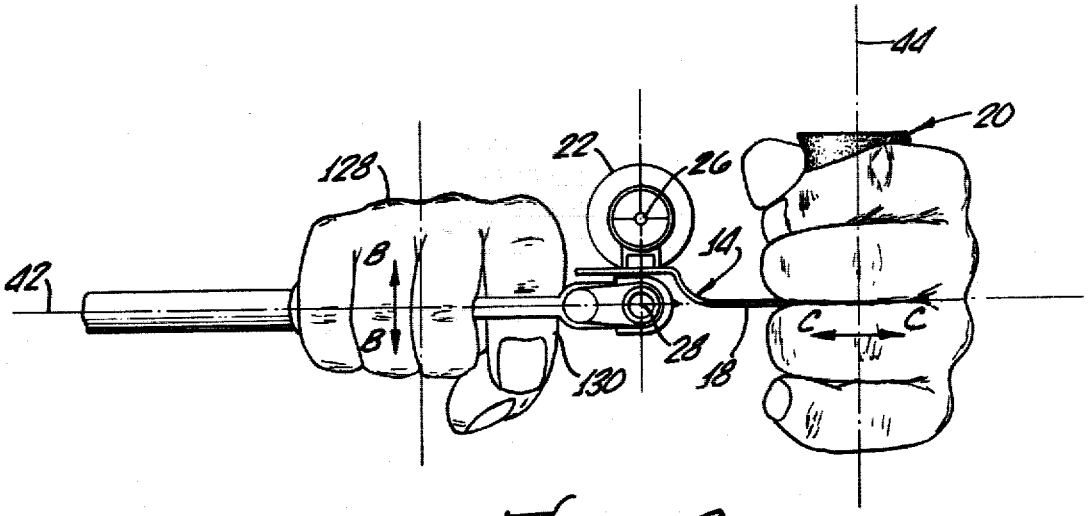
FIG. 9.

TWO HANDED HOLDING APPARATUS FOR FIREARMS

The present invention relates generally to the field of hand held firearms, and more particularly to two handed holding or gripping apparatus for such firearms.

Since hand held firearms were first developed several centuries ago, few significant advancements have been made in means for holding firearms for accurate aiming and controlled firing. Typical holding arrangements, dictated to a large extent by body limitations of users, including arm, wrist and hand articulation, still include a single, depending handle for handguns. For rifles and shotguns, shoulder stocks are provided which normally have a rearward hand hold region near a rear end of the barrel and a forward hand hold under the barrel.

Intermediate, modern types of hand held firearms, including military submachine guns and some types of machine (fully automatic) pistols, typically have both forward and rearward pistol-type handles; often, a projecting shell clip or magazine is used for one of the handles. To improve firing accuracy some of these intermediate types of firearms are also provided with folding or extendable shoulder stocks.

Since, however, hand held firearms have heretofore been provided with handles or handgrips which both extend or project to a common side of the associated barrel, firing recoil forces cause a barrel kicking moment about the holding hands, even when the firearm is held by two hands. This effect, while present in all types of hand held firearms, is most readily observed in handguns held by a single hand. Even a moderatly powered handgun, when fired, pivots about the user's holding hand in a direction causing the barrel muzzle to jump or kick upwardly.

Such muzzle jump, which progressively increases with each shot rapidly fired, has made fully automatic machine pistols, which would otherwise be very desirable in military assault applications, very ineffective. After several rapidly fired shots, the muzzle of a typical automatic handgun will have jumped upwardly so much that targets are completely missed and danger may be greater to friendly personnel than to enemy targets.

This muzzle jump problem is also experienced with submachine guns and fully automatic rifles. With some types of these firearms, the muzzle can be held down to some extent by the forward grip, nevertheless, at least when held in an aiming position, only the first two or three shots can be held on target. Although when held in an under arm position with one hand pushing down on the barrel, better muzzle control is possible, when held in such manner the weapon cannot be accurately aimed. Similarly, when an automatic weapon is held on its side so that instead of climbing the muzzle tends to sweep through a horizontal arc, as may sometimes be advantageous, accurate aiming is impossible and control is still lacking. In fully automatic rifles, muzzle jump may be reduced by providing an in line shoulder stock. However, such in line stocks make sighting difficult and recoil impact tolerance of the user's shoulder still limits the calibre and power of the weapon.

Recoil compensators or muzzle blast deflectors are used on some hand held firearms to reduce muzzle jump. By redirecting some of the high pressure barrel gases through ports in upper regions of the muzzle, a downwardly directed force is caused which tends to counter muzzle jump. But since only a relatively small percentage of gases can be deflected in this manner the muzzle blast deflectors are ordinarily relatively ineffective in reducing muzzle jump.

Because muzzle jump normally increases with firearm power which is in turn normally related to calibre, calibre of fully automatic military firearms have continually been reduced, at least in part, in attempts to reduce effects of muzzle jump and improve aiming accuracy and firing controllability. Although some improvements in these areas have been made, they have been offset by a limited firing range and less effective fire power. In additional or other attempts to control muzzle jump, burst length control is sometimes provided to limit the number of shots fired in a burst to that number which can be expected to be held on target. The result is, for example, that current concepts for fully automatic assault pistols provide for use of relatively small calibre, such as 9 mm, very rapid firing pistols mechanically constrained to fire in bursts of only three shots. The concept is that an entire three shot burst can be fired before the muzzle has climbed off the target. However, it is obvious that even when such burst limiting is effective in minimizing effects of muzzle jump, weapon effectiveness is seriously comprised due to its low fire power, since what is desired is a high powered firearm which can be accurately aimed and can fire a burst, in a controlled manner, of whatever length is necessary to achieve an objective.

Although effects of muzzle jump are obviously pronounced on fully automatic and rapid fire, semiautomatic weapons, such effects are nonetheless present and undesirable even when firearms are fired single shot or at a slow rate of fire. This is because muzzle jump movement starts while a fired projectile is still traveling down the barrel; thus, inaccuracies still result when the firearm is held at one side of the barrel.

It is apparent that to achieve aiming accuracy enabling hitting of a target with a first shot and enable continual hitting of the target with subsequently fired shots substantial improvements in the manner of holding firearms must be made.

To this end, applicant has invented two handed gun holding apparatus by means of which hand held firearms of all types can be held on opposite sides of the barrel by both hands in a manner enabling both aiming accuracy and firing controllability even when firing fully automatically without burst limitation. Because applicant's apparatus enables holding in a generally symmetrical manner, with one hand on each side of the barrel bore axis, firing recoil is relatively evenly distributed between the user's two hands, and muzzle jump is substantially eliminated.

Furthermore, since an individual's hands can withstand greater recoil impact without pain or injury, than can his shoulders, applicant's gun holding apparatus, which eliminates need for shoulder stocks, enables more effective use of high powered, fully automatic rifles than has previously been possible and as are desirable, for example, for providing defensive stand off capabilities against an attacking enemy.

Thus, applicant's holding apparatus for a hand held firearm having a barrel comprises a first handle, means for fixing the first handle to one side of a bore axis through the barrel, a second handle and means for fixing the second handle to the firearm to a side of the barrel bore axis opposite the side to which the first handle is fixed and in substantial transverse alignment therewith.

The first and second handles enable holding the firearm on opposite sides of the barrel bore axis and cause firing recoil forces to be substantially equally divided between a user's hands, in a generally symmetrical manner, to thereby eliminate muzzle jump.

More specifically, for handguns having a barrel mounting frame with a first handle projecting to one side of the barrel bore axis, the holding apparatus includes a rigid frame extension having a mounting portion and a projecting portion to which the second handle is attached. Means are provided for fixing the frame extension mounting portion to the handgun frame, with the second handle attached to the projecting portion on an opposite side of the barrel bore axis from the first handle. Preexisting handguns are modified by fixing the frame extension mounting portion to the pistol frame in place of one of the first handle handgrips, existing handgrip retaining means being used to attach the frame extension to the frame.

The frame extension mounting portion includes inwardly projecting portions for engaging peripheral regions of a preexisting, corresponding handgun frame aperture when the frame extension is mounted to the frame, handgun recoil being thereby transmitted from the frame to the frame extension by means of such engagement to prevent damage to the frame extension mounting means. Alternatively, the frame extension may be permanently fixed to the handgun frame, as by welding or being formed as an integral part of the frame.

Attachment of the second handle to the frame extension projecting portion for handguns is such that longitudinal axes of the first and second handles are orthogonal, thereby enhancing aiming precision and firing control, due to the manner in which the user's hands are positioned to hold the firearm. The second handle may provide for a full handgrip or may be of a length enabling holding by only two fingers.

Included in the frame extension may be means adapted for mounting a gun sight, included a pistol scope or open sights, to be in an uppermost portion when the firearm is held with the first handle horizontal.

For non-handgun types of firearms, a variation holding apparatus mounts coplaner first and second handles to opposite sides of the barrel forwardly of receiver portions of the firearm at a firearm balance point. Means for mounting the first and second handles include a frame member having a central aperture enabling the frame member to be slipped over the barrel.

Included, particularly for non-handgun firearms, is a sling which is attached at a rearward end of the receiver, the sling being adapted to pass around portions of a user's body to provide additional support and stability of the firearm for firing.

A better understanding of the present invention may be had from a consideration of the following detailed description, taken in conjunction with the accompanying drawings in which:

FIG. 1 is a partially cutaway perspective view of an automatic pistol having holding apparatus, in accordance with the present invention, fixed to a frame portion of the pistol;

FIG. 2 is an exploded perspective of the holding apparatus of FIG. 1, with a pistol scope removed, showing features of a frame extension and a second handle connected thereto;

FIG. 8 is a top view, showing holding of the pistol of FIG. 1 in a horizontal firing plane;

FIG. 9 is a front view, corresponding to FIG. 8, showing coplanar holding arrangement of the pistol;

Figure 3:
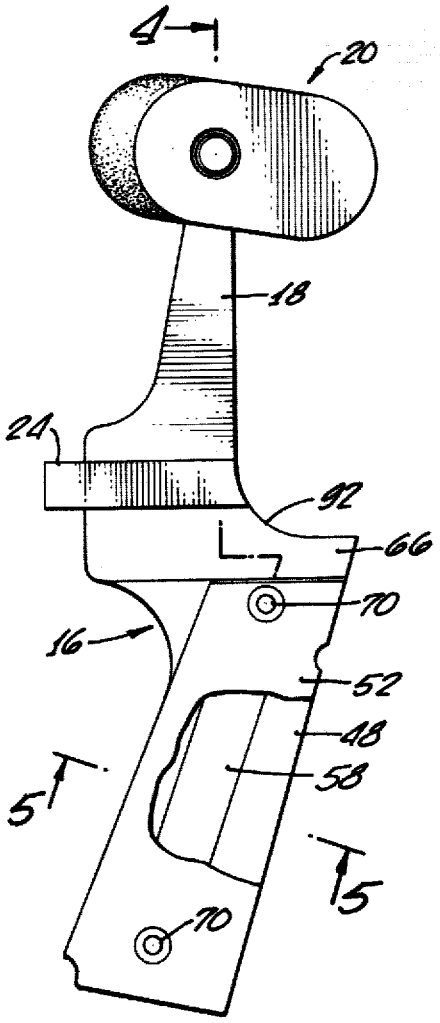
FIG. 3 is a side elevational view of the second handle and frame extension of FIG. 2.

As seen in FIG. 1, in accordance with an embodiment of the present invention, a gun holding apparatus 10, removably fixed to a conventional semiautomatic pistol 12 to form a modified pistol 14, comprises generally a rigid frame extension 16 to upwardly projecting portions 18 of which is fixed a second handle 20. As described below, similar arrangements are provided for non-handgun firearms. A conventional handgun scope 22 is shown removable mounted to an intermediate, raised portion 24 of the frame extension 16, with a longitudinal sight axis 26 thereof parallel to, and offset to one side of, a pistol barrel bore axis 28.

According to the handgun embodiment illustrated, the frame extension 16 is detachably mounted to a right hand side of a preexisting first handle or handle portion 36 of a pistol frame 38. Means attaching the frame extension 16 to the first handle 36, in place of an original handgrip (not shown), include a pair of preexisting handgrip mounting screws 40, or longer replacements thereof, which are threaded into the frame 38.

When the frame extension 16 is installed in this manner, the second handle 20 is positioned on an opposite side of the barrel bore axis 28 from the first handle 36. Thus, when the converted pistol 14 is held by separately gripping each of the two handles 20 and 36, as more fully described below, a natural, comfortable sighting position is easily achieved, as is essential to accurate aiming and shooting.

Furthermore, and very importantly, the two handles 20 and 36 cause firing recoil to be distributed to both hands in a generally symmetrical manner about the barrel bore axis 28 to eliminate muzzle jump. Hence, firing control of the converted pistol 14, particularly if the pistol 12 is configured or modified for full automatic firing, is very greatly improved over that of the pistol 12 without the apparatus 10 added.

In the pistol configuration shown, longitudinal axes 42 and 44, respectively, of the first and second handles 36 and 20 are mutually orthogonal, for reasons discussed below.

Although, holding apparatus similar to that shown in FIG. 1 can, as described below, be incorporated into a firearm during its design, the particular holding apparatus 10 shown, for illustrative purposes, is configured for removable installation onto preexisting pistols. All that is required for installing the apparatus 10 (or variations thereof according to handgun type) onto an existing handgun is removal of the handgrip screws 40 and the original handgrip, positioning of the frame extension 16 onto the handle 36 and reinstalling the handgrip screws. Although the apparatus 10 is adaptable for use on virtually any type of handgun, including revolvers, the pistol 12, for illustrative purposes only, with no limitations intended or implied, is shown to be a Colt's Government Model .45 calibre semiautomatic.

As above mentioned, for military purposes the pistol 12 may be modified (in a manner not shown) to enable fully automatic firing and may be provided with an extended capacity shell magazine 46. When so configured, and with accurate aiming and firing control enabled by the holding apparatus 10, the converted pistol 14 becomes a particularly effective high powered and accurate military assault pistol. However, these additional pistol modifications are not required to be used with the holding apparatus 10, and form no part of the present invention.

More particularly, as shown in FIGS. 2 through 6, the frame extension 16 includes a lower, mounting plate portion 48 shaped, in outline, like the original handgrip which the frame extension replaces. To match an unremoved left hand handgrip 50, a mating handgrip 52, which may be of wood or plastic, is fixed to the outside of the mounting portion 48, for example, by several small screws 54 installed outwardly through corresponding frame extension apertures 56. Alternatively, for military-type pistols in which appearance is ordinarily not important, the mounting portion 48 may be contoured in cross section, when constructed, to include the handgrip 52 as an integral part to avoid necessity for a separate handgrip.

When the separate hangrip 52 is used, the frame extension mounting portion 48 is generally required to be relatively thin so as to minimize handle thickness. To ensure strength and rigidity in such case, even when the frame extension 16 is constructed of steel or high strength aluminum alloy, the frame extension is formed having a central stiffening rib 58 (FIGS. 3 through 5) which extends the length of the mounting portion 48, in the region of the screw apertures 60, from a thicker, intermediate extension region 66. To enable fitting over the rib 58, the handgrip 52 is formed having a mating inner recess 68. Apertures 70, in the region of the handgrip recess 68, receive head portions of the handgrip screws 40 upon assembly. Smaller recesses 72, extending into the handgrip 52 from an inner surface 74 thereof, receive the handgrip-to-frame extension attachment screws 54.

To prevent shearing of, or damage to, the handgrip screws 40, particularly in large calibre handguns where such screws may be too weak to transmit recoil forces from the frame 38 into the frame extension 16 and handle 20, the frame extension mounting portion 48 is preferably formed with a raised annular ridge 80 which, on attachment, closely fits into a preexisting aperture 82 in the pistol frame 38. In this respect, it should be noted that nearly all pistols have such frame apertures 82, either for access or frame lightening. When the modified pistol 14 is fired, shear loads are transmitted from the frame 38 into the frame extension 16 through the relatively large area of the ridge 80 and not through the screws 40 which are principally used to keep the ridge in the aperture 82.

Above the mounting portion 48, shape of the frame extension 16 is further dictated by configuration and operation of the associated pistol 12. For example, the upwardly projecting portion 18 of the frame extension 16 must, for the type pistol 12 shown, be offset or stepped rearwardly to maintain strength and rigidity while at the same time enabling unimpeded ejection of fired shell casings through an ejection port 88 formed in a pistol slide 90 (FIG. 1). Accordingly, when the slide 90 is recoiled rearwardly after firing, a frame extension forward surface 92 must still be rearwardly of the ejection port 88 to prevent interference with ejected casings.

Another factor which may be, in some circumstances, considered in establishing contour of the frame extension forward surface 92 is that of providing clearance for preexisting types of gun holsters so that the converted pistol 14 can be conviently carried. It should be noted that when carried in a conventional holster, forward portions of the scope 22 are outside the holster and thus provide no interference.

To clear side surfaces for movement of the slide 90, an inner surface 94 (FIG. 4) of the frame extension upper portion 18, above the region 66, is slightly recessed or stepped outwardly. Thereabove, the projecting portion 18 is curved around the top of the slide 90 so that a projecting portion upper end 96, to which the handle 20 is fixed, is in a plane passing through the barrel bore axis 28. Stated otherwise, when the converted pistol 14 is held vertically, as shown in FIG. 5, the frame extension upper end 96 is directly above the barrel bore axis 28, as is necessary for symmetrically dividing the recoil forces.

Figure 4:
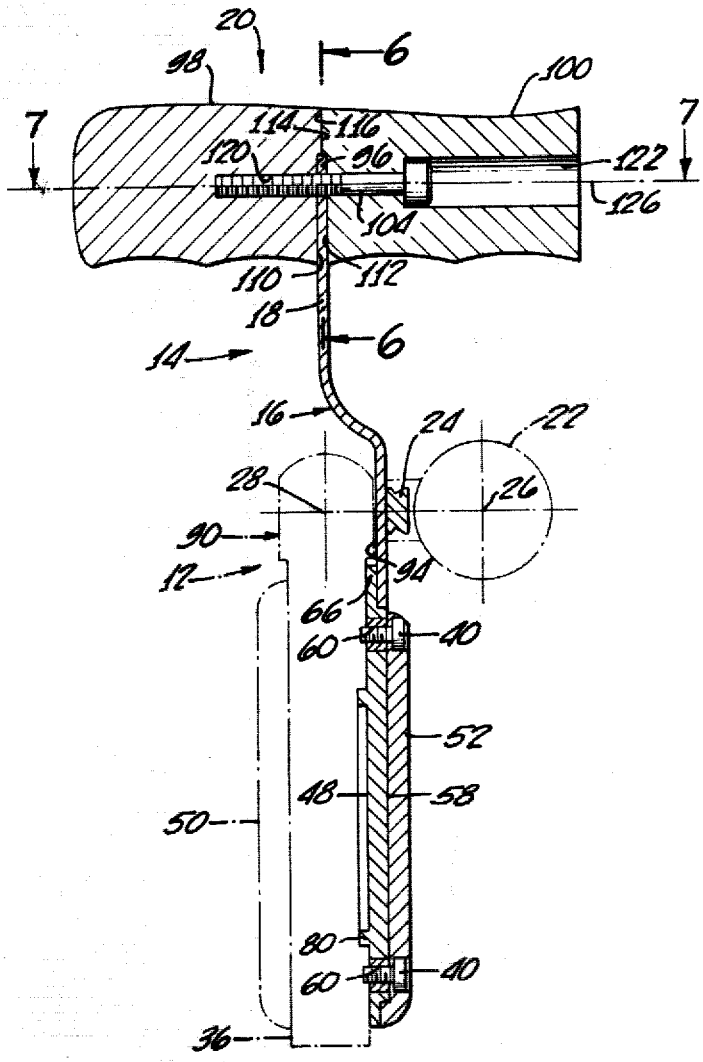
FIG. 4 is an offset, vertical sectional view, taken along line 4—4 of FIG. 3, showing assembly of the second handle and frame extension, and showing, in phantom lines, the outline of the associated pistol and pistol scope.
Figure 6:
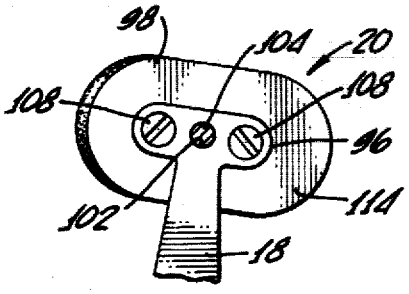
FIG. 6 is a vertical sectional view, taken along line 6—6 of FIG. 4, showing mounting of the second handle to projecting end portions of the frame extension.
Figure 5:
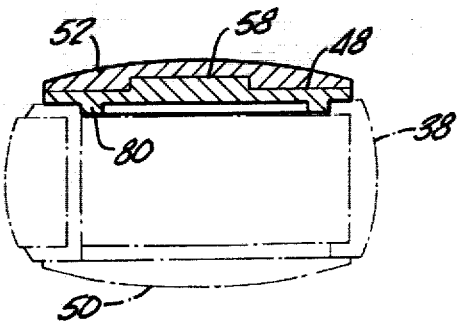
FIG. 5 is a transverse sectional view, taken along line 5—5 of FIG. 3, showing features of the frame extension and showing a handgrip attached thereto.
Figure 7:
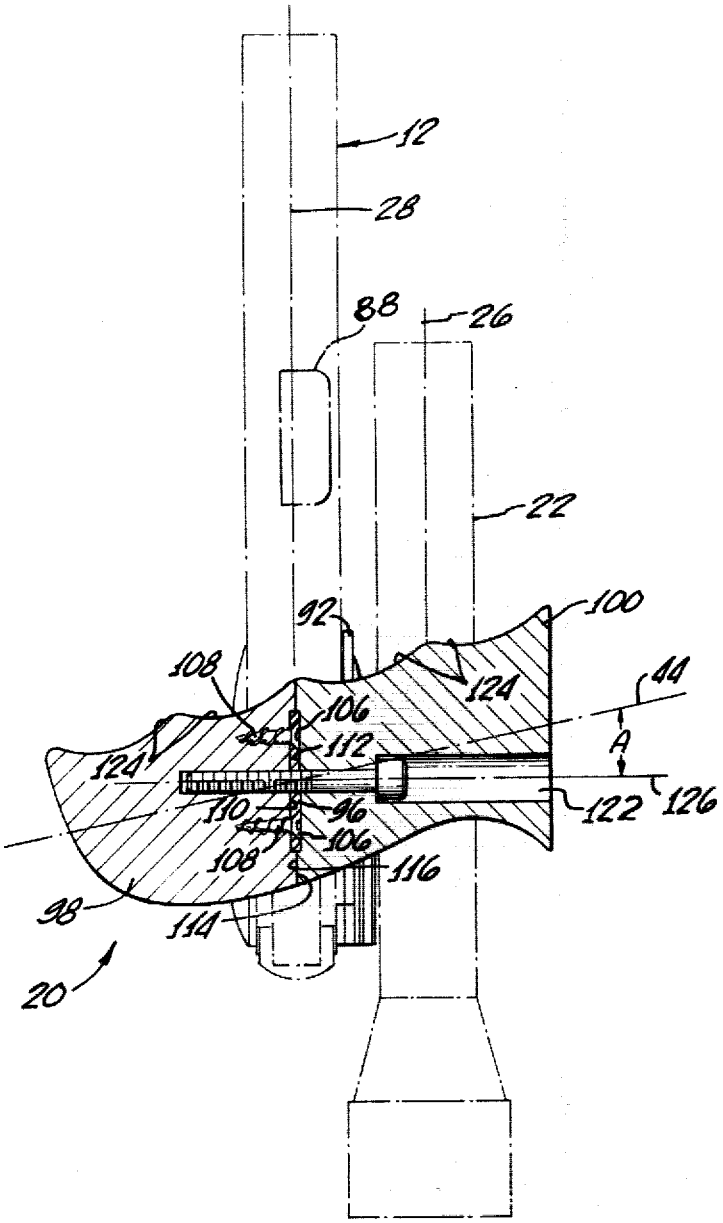
FIG. 7 is a sectional view, taken along line 7—7 of FIG. 4, also showing mounting of the second handle to the frame extension.

As seen in FIGS. 4 and 7, the handle 20, which provides a full hand hold, comprises mating first and second handle sections 98 and 100, respectively, which may be made of wood or plastic to match the handgrip 52. Alternatively, the handle 20 may be cast or formed integrally with the frame extension 16.

Assuming the detachable handle 20 shown, the frame extension upper end 96 is enlarged in transverse area to form an oval region having a threaded central aperture 102 (see also FIG. 7) for receiving, on assembly, a handle assembly bolt 104.

On either side of the central aperture 102 are screw apertures 106 for receiving screws 108 which attach the first handle section 98 to the frame extension upper end 96. Recesses 110 and 112, which match the contour of the frame extension upper end 96, are formed into transverse surfaces 114 and 116, respectively, of the first and second handle sections 98 and 100 to receive the upper end 96. Handle clearance for the bolt 104 is provided by a cylindrical recess 120 formed into the first handle section 98, from the surface 114, in alignment with the aperture 102. The recess 120 may also be threaded to receive the bolt 104 to provide additional handle rigidity.

Formed as an extension of the first section 98, the second handle section 100 transverse surface 114 abutts, on assembly, the first section surface 112. A stepped cylindrical aperture 122 through the handle second section 100 receives the bolt 104. After the handle sections 98 and 100 have been assembled onto the frame extension upper end 96 by the screws 108 and 104, the open end of the aperture 122 in the second section may be plugged or capped to match the rest of the handle 20.

The handle 20, as seen in FIGS. 1, 2 and 7, is contoured to comfortably and securely fit a user's hand. Accordingly, four fingers recesses or grooves 124 are formed into forward regions of the handle 20.

As seen in FIG. 7, the longitudinal axis 44 of the second handle 20, shown configured for a user's left hand, is at a angle "A" to a line 126 orthogonal to the barrel bore axis 28. The angle "A", which is preferably about fifteen to twenty degrees, or approximately equal to a typical angle formed between an individual's closed hand and wrist, enables a natural, comfortable handgrip on the handle 20 when the modified piston 14 is in an arm extended aiming and firing position. The plane of the transverse handle section surfaces 114 and 116 determine the angle "A". It is to be appreciated that the angle "A" can be slightly adjusted to an individual users preference without changing the handle 20 by twisting the frame extension projecting portion 18 a slight amount.

To accomodate left handed shooters, who would normally hold the second handle 20 by their right hand, instead of their left hand, the second handle can easily be reversed, after removal, by attaching the first handle section 98 to an opposite side of the frame extension upper end 96. However, configuration of the entire apparatus 10 in mirror image form, and attaching the apparatus to the left hand side of the pistol is preferred for left handed shooters, as will be apparent from discussions below.

Figure 10:
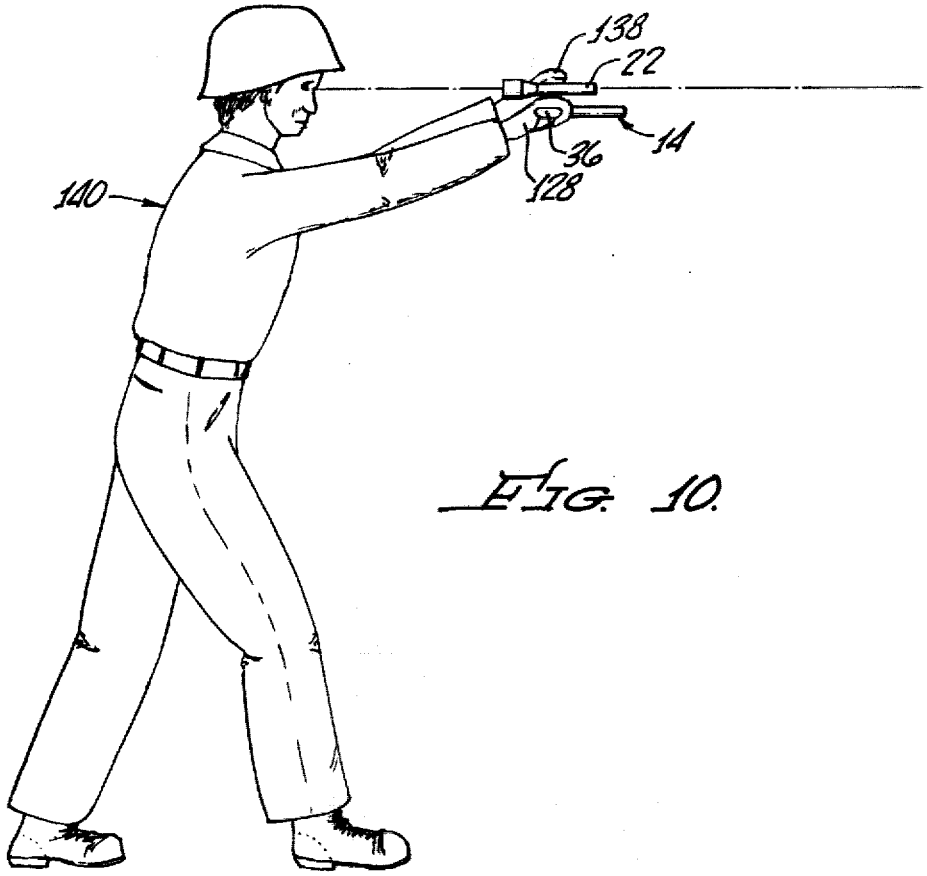
FIG. 10 is a pictorial drawing showing an individual holding the pistol of FIG. 1 in a typical aiming and firing position.

Holding orientation of the converted pistol 14 for shooting is illustrated in FIGS. 8 through 10. Assuming right handed shooters, the first handle 36 is held by a user's right hand 128, with a first finger 130 positioned over a trigger 132 (FIG. 1) in a normal trigger actuating manner. A user's left hand 138 holds the second handle 20 with two fingers on each side of the frame extension projecting portion 18 (FIG. 9).

For accurate aiming and firing, as depicted in FIG. 10, an individual 140 holds the converted pistol 14 horizontally on its side at arms length and eye level. In this position, as more clearly seen in FIG. 9, the first handle axis 42 is in a horizontal plane and the second handle axis 44 is in a vertical plane, both axes being mutually orthogonal as seen in a front view.

That such configuration provides substantial holding stability is apparent from a consideration of typical hand articulation relative to the attaching wrist. In the holding configuration shown, the horizontal right hand 128 can move relatively freely upwardly and downwardly (direction of Arrow B—B). However, because the wrist of the vertical left hand 138 is relatively rigid against upward and downward movement, up and down waver of the converted pistol 14 during aiming and firing is largely prevented. In a like manner, tendency of the left hand 138 to pivot left and right (direction of Arrow C—C) is resisted by the rigidity of the right hand 128 due to its horizontal orientation. Side to side waver is thus also prevented. As a result, steady aiming and firing of the converted pistol 14 is attained.

Also, very importantly, the frame extension projecting portion 18 is preferably constructed having a length which divides firing recoil forces equally between the right and left hands 128 and 138 with the divided forces acting symmetrically about the barrel bore axis 28. Accordingly, as seen in FIG. 8, half the recoil force, F/2, acts rearwardly (direction of Arrow "D") through the center of the right hand 128 with the other half of the recoil force, F/2, acting rearwardly in a parallel direction (Arrow "E") through the center of the left hand 138. Since both the divided recoil forces, F/2, are equally distant from, as well as being on directly opposite sides of the barrel bore axis 28, twisting moments on individual ones of the hands 128 and 138, which would otherwise result in muzzle jump, are balanced so that no muzzle jump can occur.

When the converted pistol 14 is held horizontally, as illustrated and described for optimum aiming and firing control, preexisting open sights 144 on upper surfaces of the pistol 12 (FIGS. 8 and 9) are difficult to use. Hence, the desirably of the "side" mounted scope 22 which, in the horizontal pistol aiming and shooting orientation, is upwardly positioned in the line of sight and is thus used instead of the sights 144.

Figure 11:
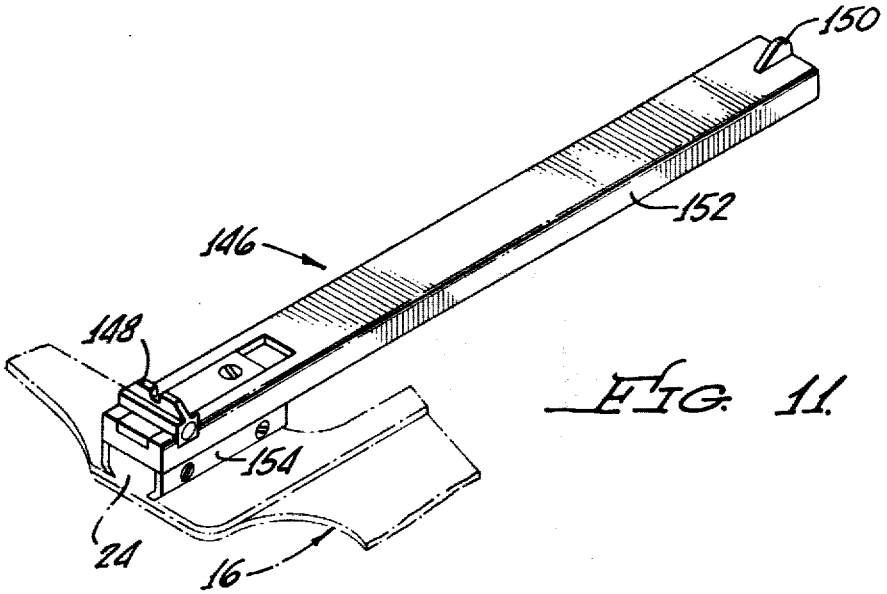
FIG. 11 is a perspective of an alternative type sight replacement for the pistol scope.

Although providing very accurate aiming, use of the scope 22, because of its limited field of view and other characteristic limitations, may sometimes be undesirable on some types of pistols such as those requiring concealment and fully automatic assault pistols. If that is the case, the scope 22 can be replaced by an open sight assembly 146 (FIG. 11). Comprising the exemplary open sight assembly 146 is an adjustable rear sight element 148 and a front sight element 150. Both the sight elements 148 and 150 are fixed to a bar 152 having screw tightened clamping legs 154 which enable clamping of the assembly 146 onto the frame extension portion 24 in place of the scope 22.

As an alternative to mounting sights on the frame extension 16, and as described below, open sights can be fixed to whichever side of the pistol will be uppermost when firing.

Although, preferably held in the above described horizontal position for firing, the converted pistol 14 is capable of being fired from the hip, unaimed but still without muzzle jump, with the left hand 138 above, rather than to one side of, the right hand 128. In this holding orientation, FIG. 8 would represent a side, rather than a top, view. Furthermore, when desired or necessary, but without the described advantages, the converted pistol 14 can still be held and fired in the conventional, single handed manner. For such single handed shooting, the holding apparatus 10 does not interfere with, and need not be removed from, the pistol 12.

It is to be understood that variations necessary to conform the apparatus 10 to different types of firearms and to particular uses are within the scope of the invention. For example, for use by left handed shooters, the frame extension 16 can be configured in mirror image form for mounting on the left hand side of the pistol frame 38. In such case, the scope 22, would also be on the left hand side, to be in a sighting position above the bore axis 28 when the pistol is held horizontally. Also, for some types of firearms, a pair of frame extensions meeting at the second handle and individually fixed to opposite sides of the pistol frame may be useful or desirable.

Figure 12:
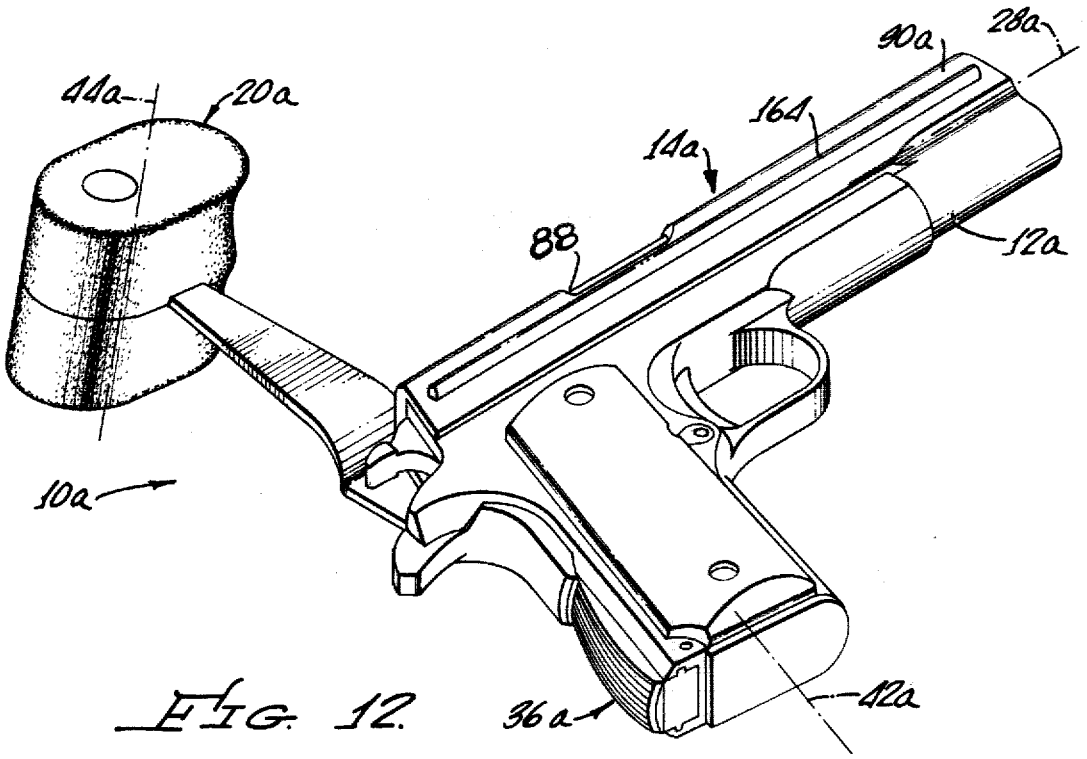
FIG. 12 is a perspective view, similar to FIG. 1, showing a variation second handle and frame extension permanently fixed to an automatic pistol.
Figure 13:
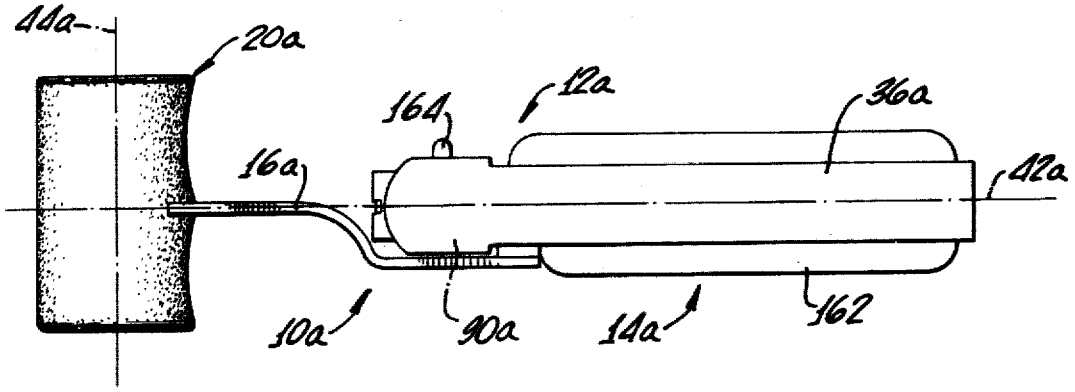
FIG. 13 is a rear view of the pistol of FIG. 12, showing features of the second handle and frame extension.

For other uses, such as when full automatic firing is provided and use of the pistol 12 without the holding apparatus 10 is not contemplated, the frame extension 16 may be formed as an integral part of the pistol, as is illustrated in FIGS. 12 and 13. For purposes of description, elements and features shown in FIGS. 12 and 13 identical to those previously described are given identical reference numbers. Corresponding, but non-identical elements and features, are given the original reference number followed by an "a".

A pistol **12*a* of FIGS. 12 and 13 is, for illustrative purposes, shown to be of a smaller type, than the pistol 12, as may be desired for easier carrying and concealment. For example, the pistol 12*a* may, be a Colt Commander .45 semiautomatic which is similar to, but smaller than, the previously illustrated Colt's Government Model. In the pistol 14*a*, a short rigid frame extension 16*a*, for example, made of steel, is permanently fixed to the left hand side of a pistol frame 38*a* above a left handgrip 162 by welding onto, or being machined as an intergral part of, the frame. To reduce size, a second handle 20*a* is constructed shorter than the handle 20 so as to enable gripping by only two fingers of a user's left hand. This is in contrast with the four finger grip provided by the handle 20**.

As illustrated, the frame extension **16*a* is formed without scope or sight mounting provisions. Instead, an elongated sighting ramp 164 is installed along the right hand side of a pistol slide 90*a*. The sight ramp 164 is made sufficiently low to enable the pistol 14*a* to fit into conventional standard sized holsters (not shown) without modification thereof. Alternatively, the slide mounted ramp 164 can be replaced by a slide mounted sight similar to the sight assembly 146 (FIG. 11) without the clamping legs 154**.

Otherwise, the permanent holding apparatus **10*a* is substantially as above described for the removable holding apparatus 10. The handle 20*a* is thus mounted to the frame extension 16*a* in the same way the handle 20 was described as being mounted to the frame extension 16. Likewise, the pistol 14*a* is held, for aiming and controlled firing, in the way described for the converted pistol 14, the only difference being that the handle 20*a*, because of its shorter length is gripped by only two fingers. Such shorter handle 20*a* can, of course, be replaced by a handle identical to the longer handle 20** to thereby enable a full hand hold.

In a completely analgous manner, as seen in the "long gun" variation of FIGS. 14 through 17, two handed, symmetrical holding of non-handgun firearms, such as rifles, is provided. However, because such firearms ordinarily lack preexisting handles which can be utilized as a first handle, for example, because of shape and positioning, both first and second handles must ordinarily be attached to the firearm.

Figures 14, 16:
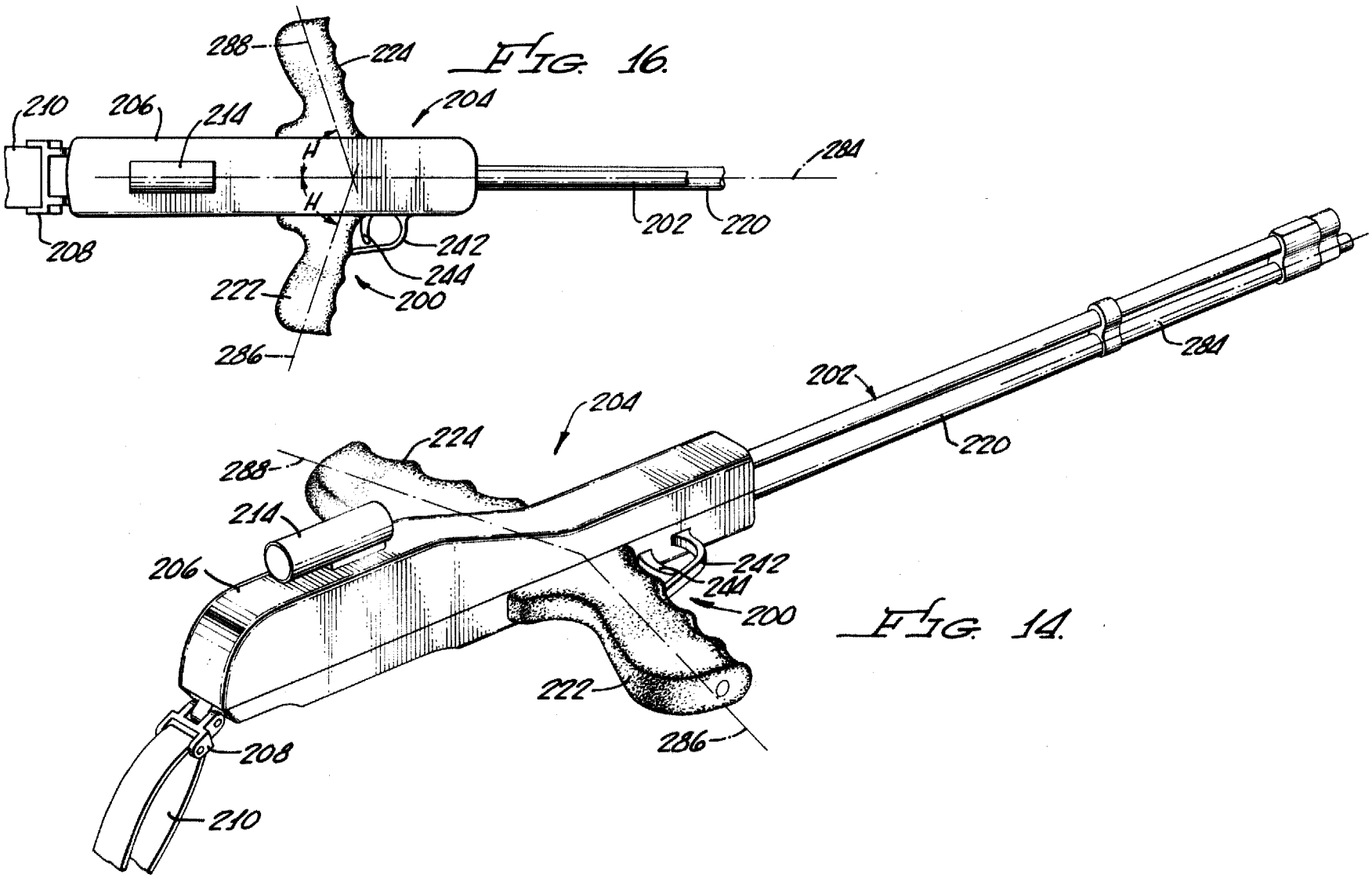
FIG. 14 is a perspective view of a stockless, automatic rifle to which is shown connected a two handed holding apparatus, according to the present invention.
FIG. 16 is a plan view, showing holding of the automatic rifle of FIG. 14 for aiming and firing.

As seen in FIG. 14, a two handed holding apparatus 200 is fixed to a rifle 202, preferably of full or semi automatic type, from which the original stock has been removed, to provide a modified, two handed rifle 204. For illustrative purposes, again with no limitations intended or implied, the rifle 202 is shown to be a Garand M-1 30.06 calibre semiautomatic rifle of the type widely used by the United States in World War II and the Korean War, which may be modified, in a manner not shown, for full automatic firing. Modification of the rifle 202, after addition of the below described handles is completed with the addition of a short replacement stock 206 for enclosing working portions of the rifle, including the original receiver and trigger mechanism.

Attached to a rearward end of the stock 206, by a swivel mount 208, is a sling 210 which is used for carrying the modified rifle 204 and for weapon steadying purposes during firing, as described below. Shown mounted on top of the added stock 206 is a conventional reflex type sight 214. As a matter of choice, particularly to enable use of an extended capacity magazine (not shown) without affecting sighting, in the event the rifle is converted for fully automatic firing, the rifle 202 is inverted for firing so that the sight 214 is mounted just above the original bottom of the rifle receiver.

As so configured, the two handed rifle 204, although unusual in appearance, is not only lighter in weight than the M-1 rifle from which it was converted, but is also at least as easy to aim accurately and is much easier to control when rapidly fired either in the original, semiautomatic mode or in a converted, fully automatic mode.

Figure 15:
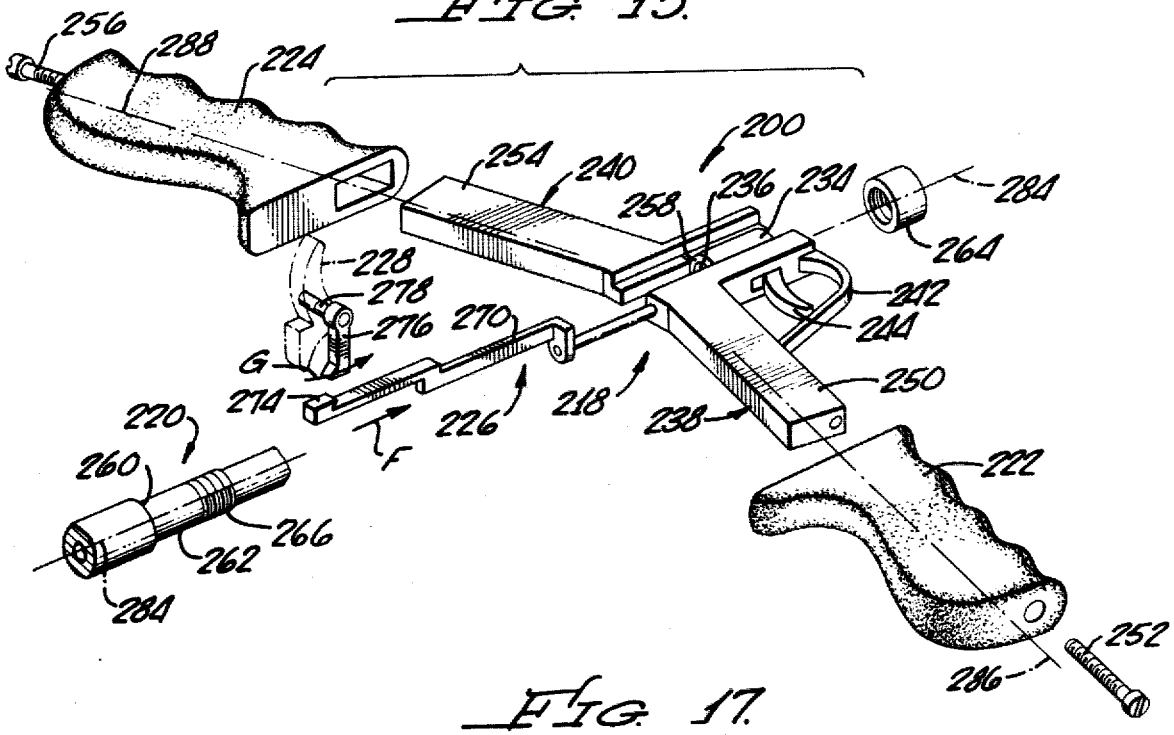
FIG. 15 is an exploded perspective view of the automatic rifle of FIG. 14, showing features of the holding apparatus.

As best seen in FIG. 15, the holding apparatus 200 includes a frame member 218 which attaches directly to an original barrel 220 of the rifle 202. Mounted to the frame 218 in a symmetrical manner are first (right hand) and second (left hand) handles 222 and 224, respectively. Included in the apparatus 200 is a trigger actuating mechanism or means 226 which engages, to enable firing, preexisting portions of a trigger 228, original finger engaging portions of which may be removed as unnecessary.

More specifically, the frame member 218 includes a tubular, central portion 234 having a longitudinal barrel receiving aperture 236. Connected to opposite sides of the tubular portion 234, in coplaner relationship, are first and second frame portions 238 and 240 to which the respective first and second handles 222 and 224 are removably attached. Included as part of the first frame portion 238 is a trigger guard 242 which encloses a movable trigger element 244 associated with the trigger actuating mechanism 226.

For assembly, the first handle 222 is slipped onto a projecting arm 250 of the first frame portion 238 and is held thereon by a mounting screw 252. Similarly, the second handle 224 is mounted to the second frame portion 240 by slipping onto a projecting arm 254 thereof, being held thereon by a mounting screw 256.

For installing on the rifle 202, the frame member 218 is slid rearwardly over the barrel 220 until a rearward, annular face 258 of the tubular central portion 234 abutts a shoulder 260 on the barrel rearwardly of a handle apparatus mounting region 262.

Conventional keying means (not shown) may be provided to prevent rotational movement of the member 218 on the barrel 220. A retaining nut 264 is then tightened onto a threaded region 266 of the barrel 220 forwardly of the mounting region 262 to lock the frame member 218 on the barrel in the desired rotational position.

The trigger actuating mechanism 226 necessarily varies in configuration according to the type of firearm to which the apparatus 200 is mounted and according to mounting position of the holding apparatus relative to the preexisting trigger.

When a conventional firearm having a trigger adjacent a receiver portion is modified in the manner illustrated to have the handle apparatus 200 located at a balance point of the modified rifle 204, an elongated, rearwardly extending actuating link 270 is generally required. A rearward end 274 of the actuating link 270 is positioned in engagement with an actuating arm 276 fixed to the trigger 228 by a pin 278.

Within the frame portion 238, a forward end of the actuating line 270 is engaged by the trigger element 244. Operation of the trigger actuating mechanism 226 is such that pulling the trigger element 244 rearwardly in a normal manner pulls the actuating link 270 forwardly (direction of Arrow "F"). In turn, this forward movement of the actuating link 270 pulls the actuation arm 276 forwardly (direction of Arrow "G") to fire the firearm by actuation of the trigger 228. As necessary, means (not shown) may be provided for supporting and guiding the trigger actuating link 270.

It is to be appreciated, however, that in designing a new rifle or similar firearm which is to incorporate the first and second handles 222 and 224, the frame member 218 may be formed as an integral part of the firearm frame or receiver and the trigger mechanism 226 may be more fully integrated than is possible when modifying a preexisting firearm.

As above mentioned, the first and second handles 222 and 224 are preferably mounted, for optimum aiming accuracy and control of firing, at a balance point of the converted rifle 204. Since this balance point necessarily shifts according to shell loading, the balance point may, for example, be that established when the modified rifle 204 is fully loaded and in horizontal position.

A readily apparent difference between the holding apparatus 200 and the handgun holding apparatus 10 and **10*a* is relative orientation of the first and second handles 222 and 224. Instead of the previously described orthogonal relationship of the described pistol handles 20 and 36, the two handles 222 and 224 are shown positioned in a common plane which passes through a barrel bore axis 284**.

Although this coplaner handle arrangement does not completely provide the previously described advantages of preventing gun wobble associated with the orthogonal mounted pistol handles 20 and 36, the coplaner arrangement of the handles 222 and 224 provides other advantages which are important to large calibre, high powered rifles. Since the handles 222 and 224 are angled slightly rearwardly so that longitudinal axes 286 and 288, respectively, thereof are at identical angles "H" with the barrel bore axis 284 (FIG. 16) the modified rifle 204 is held by both hands of a user in a natural, completely symmetrical manner.

Due to orthogonal relationship of the handles 36 and 20 on the converted pistol 14, which enables the described holding stability, recoil forces, even though equally divided between the user's hands 128 and 138, may be slightly differently resisted by the non-symmetry of the user's arms. That is, different muscles, which may be differently responsive to recoil forces, may be used in each arm, and the same muscles used in each arm may be used to different degrees.

When firing two handed handguns, pistol calibre submachine guns or small calibre rifles, the effect of non-symmetrical arm use is ordinarily negligable. However, when firing high powered rifles or large calibre submachine guns having much greater recoil forces, the unequal recoil response associated with non-symmetrical arm use may cause an unbalanced recoil moment with some resultant muzzle jump.

To avoid the possibility of such unequal recoil response, the handles 222 and 224 of the modified rifle 204 are, as above described and as best illustrated in FIG. 16, completely symmetrical about, as well as being coplaner with, the barrel bore axis 284. As a consequence, the holding arms are symmetrically positioned to enable equal response to firing recoil forces.

With either the described coplaner arrangement of the handles 222 and 224, or with the alternative orthogonal handle arrangement shown for the pistol handles 20 and 36, which may alternatively be used on some types of non-handguns, the sling 210 provides additional holding stability for accurate aiming and firing control.

Figure 17:
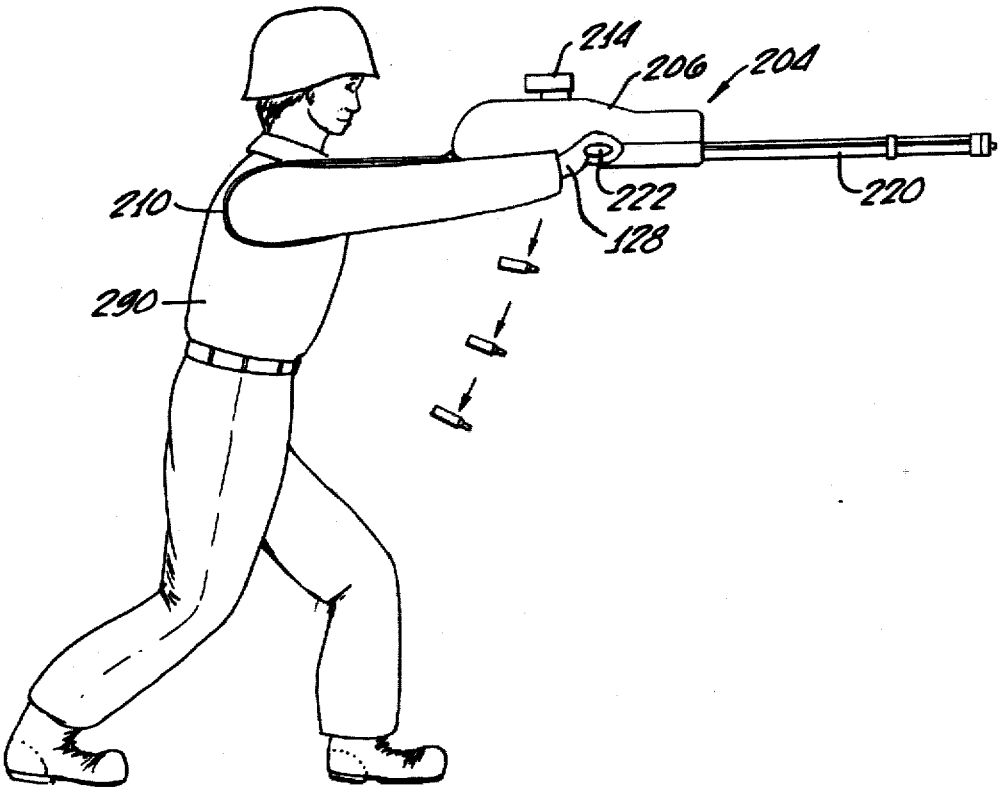
FIG. 17 is a side view, also showing holding of the automatic rifle of FIG. 14 for aiming and firing.

As shown in FIG. 17, the sling 210 is configured for passing around behind the neck and forwardly under one arm of an individual 290 holding the modified rifle 204 in a firing position with the handles 222 and 224 generally horizontal (assuming an eye level target). The sling 210 is adjusted for length so the individual 290 can push the modified rifle 204 forwardly and outwardly against sling tension to nearly an arm's length position, very steady and natural aiming and firing being thereby provided.

This manner of holding, with the arms pushing the modified rifle forwardly away from the body against the sling 210, as opposed to pulling the firearm back into tight shoulder contact when a conventional shoulder stock is used, also helps absorb and reduce recoil effects. Ability of the user's hands to withstand much greater recoil impact without pain than can his shoulders, makes even very high powered rifles easy and comfortable to shoot.

As mentioned above, the orthogonal mounting relationship of the pistol handles 20 and 36, may be useful or prefered on some types of non-handguns, for example, compact, small calibre submachine guns. For such firearms, the transverse mounting orientation of the second handle, also provides convenient means for carrying the weapon.

A coplaner handle mounting, similar to that of the rifle handles 222 and 224 with or without a sling 210, may be useful or prefered on some types of handguns.

Furthermore, a frame extension and frame member portions corresponding, respectively, to the frame extension 16 and the frame portion 254, may be configured to enable a second handle, corresponding to the handles 20 or 224, to be installed in either a coplaner or an orthogonal relationship to the first handle, although different second handles may be required for each orientation. Furthermore, it should be understood that the term "two handed holding apparatus" as used herein, since modifications to preexisting firearms, as well as design of new firearms, is contemplated, includes use of an existing handle, such as the pistol handle 36, only an additional second handle being actually provided for such firearms.

Thus, although there have been described above specific arrangements of two handed holding apparatus for hand held firearms in accordance with the invention for purposes of illustrating the manner in which the invention may be used to advantage, it will be appreciated that the invention is not limited thereto. Accordingly, any and all modifications, variations or equivalent arrangements, not limited to those described or mentioned above, which may occur to those skilled in the art should be considered to be within the scope of the invention as defined in the appending claims.

I claim:

1. Holding apparatus for a hand held firearm having a barrel, which comprises:

(a) a first handle adapted for being held by one of a user's hands, (b) means for fixing said first handle to the firearm to one side of a bore axis through said barrel, (c) a second handle adapted for being held by the other one of a user's hands, and (d) means for fixing said second handle to the firearm to a side of the barrel bore axis opposite to the side to which the first handle is fixed and in general transverse alignment, relative to the barrel bore axis, therewith so that the firearm can be held in an aiming position with both arms of a user equally extended, thereby enabling generally equal distribution of firing recoil forces between the user's two hands and generally equal and opposite holding moments thereby, muzzle jump being thereby substantially prevented.

2. Holding apparatus for a hand held firearm having a barrel, which comprises:

(a) a first handle adapted for being held by one of the user's hands;

(b) means for fixing said first handle to the firearm to one side of a bore axis through said barrel;

(c) a second handle adapted for being held by the other one of a user's hands;

(d) means for fixing said second handle to the firearm to a side of the barrel bore axis opposite to the side to which the first handle is fixed; and (e) a gun sling fixed to the firearm rearwardly of the first and second handles, said sling being adapted for enabling carrying of the firearm by a user and for passing behind portions of a user's body when the firearm is to be fired, said sling having a length enabling the firearm to be held at arm's length by the user when the sling passes behind said portions of the user's body, additional stability of the firearm for firing thereby being provided.

3. Holding apparatus for a hand held firearm, which comprises:

(a) first and second handles each adapted for being separately held by one of a user's hands; and, (b) means fixing said first and second handles to the firearm on opposite sides of a barrel bore axis thereof and in general transverse alignment with one another for enabling firing recoil forces of the firearm to be substantially equally divided between both of a user's hands holding the firearm by the handles and for providing substantially equal and opposite holding moments, thereby controlling muzzle jump, said fixing means fixing the handles on the firearm in positions enabling a user's hand holding one of the handles to trigger firing of the firearm.

4. Holding apparatus for a hand held firearm, which comprises:

(a) a first handle adapted to be gripped by one of a user's hands, said first handle being fixed to the firearm to one side of the barrel bore axis of the firearm; and, (b) a second handle adapted to be gripped by the other one of the user's hands, said second handle being fixed to the firearm to a side of the barrel bore axis opposite to said first handle, and in general transverse alignment, relative to the barrel bore axis, therewith, said first and second handles being fixed to the firearm in locations enabling the firearm to be held in an aiming position with both arms of a user equally extended, thereby causing firing recoil forces on a user's hands holding the firearm by said first and second handles to be in a plane through the barrel bore axis and, to be substantially equally divided between the user's two hands with substantially equal and opposite holding moments being provided.

5. Two handled gun holding apparatus for a firearm; which comprises:

(a) first and second handles, each adapted for being separately held by one of a user's hands; and (b) means fixing said first and second handles to the firearm on opposite sides of a barrel bore axis thereof in transversely aligned positions relative to the barrel bore axis for enabling the firearm to be held in an aiming position with both arms of a user equally extended, thereby causing recoil forces due to firing to be transmitted in a generally symmetrical manner, said means fixing the first and second handles to the firearm at a center of balance of the firearm when the firearm is fully loaded and pointed in a horizontal direction.

6. Two handed holding apparatus for a handgun having a barrel and a barrel mounting frame with a first handle projecting to one side of a barrel bore axis, the apparatus comprises:

(a) a rigid frame extension;

(b) means fixing the frame extension to said barrel mounting frame with projecting portions of the extension extending to a side of the barrel bore axis opposite from said first handle;

(c) a second handle, and (d) means fixing the second handle to the projecting portion of the frame extension in opposing relationship to, and on an opposite side of, the barrel bore axis from the first handle, the handgun being thereby capable of being held by both hands of a user, with the hands positioned on opposite sides of the barrel bore axis to control muzzle jump associated with firing of the handgun.

7. The handgun holding apparatus according to claim 6, wherein the first handle includes a pair of hand grips removably fixed to the frame by hand grip retaining means, and wherein the frame extension includes a mounting portion remote from the projecting portion and configured to mount to the frame in place of one of the hand grips, and wherein the means fixing the extension to the frame includes the hand grip retaining means.

8. The handgun holding apparatus according to claim 7, wherein the frame includes means defining frame apertures in regions covered by said hand grips and wherein the mounting portions of the frame extension include means defining inwardly projecting portions for engaging a corresponding one of said apertures when the frame extension is fixed to the frame by the hand grip retaining means.

9. The handgun holding apparatus according to claim 6, wherein longitudinal axes of the first and second handles are mutually orthogonal.

10. The handgun holding apparatus according to claim 6, wherein the frame extension includes means adapted for mounting a gun sight to the frame extension to enable sighting of the handgun when the handgun is held with the first handle in a horizontal position.

11. The handgun holding apparatus according to claim 6, including auxiliary sighting means fixed to a side of the handgun intermediate the first and second handles to enable sighting of the handgun when the handgun is held with the first handle in a horizontal orientation.

12. The handgun holding apparatus according to claim 6, wherein the second handle is constructed having a length enabling holding by only two fingers of the user's hand.

13. Two handed holding apparatus for a handgun including a barrel and a barrel mounting frame having a first handle projecting to one side of a barrel bore axis, the apparatus comprises:

(a) a rigid frame extension having projecting portions extending to a side of the barrel bore axis opposite from said first handle; said extension being permanently joined to the frame;

(b) a second handle, and (c) means fixing the second handle to the projecting portion of the frame extension in opposing relationship to, and on an opposite side of, the barrel bore axis from the first handle, the handgun being thereby capable of being held by both hands of a user with the hands positioned on opposite sides of the barrel bore axis to eliminate muzzle jump associated with firing of the handgun.

14. A two handed handgun, which comprises:

(a) a barrel, (b) a frame mounting said barrel, said frame including portions defining a first handle projecting to one side of a bore axis of the barrel, (c) a frame extension having a projecting, second handle mounting portion, (d) means mounting the frame extension to the frame with the projecting second handle mounting portion thereof projecting to a side of the barrel bore axis opposite to said first handle and generally transversely aligned therewith, and (e) a second handle and means mounting the second handle to said projecting second handle mounting portion of the frame extension, thereby enabling the handgun to be held by two hands, positioned on opposite sides of the barrel, to control muzzle jump caused by firing of the handgun by substantially equally dividing firing recoil forces between said two hands holding the gun with substantially equal and opposite holding moments being provided.

15. A hand held firearm which comprises:

(a) a barrel, (b) a receiver mounting said barrel, the receiver portion including means for mounting a shell magazine, (c) a first holding handle fixed to the barrel at a balance point of the firearm, forwardly of said magazine, said first handle projecting to one side of the barrel, (d) a second holding handle fixed to the barrel on an opposite side of the barrel from and, in alignment with, said first handle; thereby enabling the firearm to be held with both of the user's hands with one hand positioned on each side of a bore axis through the barrel, and (e) means for firing the firearm, said means being adapted for operation operable by one of a user's hands holding one of the handles.

16. The firearm according to claim 15, wherein longitudinal axes of the first and second handles are in a common plane through the barrel bore axis.

17. The firearm according to claim 15, including a sling connected at a rearward end of the receiver, said sling being adapted to pass around portions of a user's body to provide additional support and stability of the firearm for firing.

18. The firearm according to claim 15, including sighting means fixed to the firearm for enabling sighting of the firearm when the firearm is held by the first and second handles in a horizontal firing position.

* * * * *